US006028518A

United States Patent [19]

Rankin et al.

[11] Patent Number: 6,028,518

[45] Date of Patent: Feb. 22, 2000

[54] SYSTEM FOR VERIFYING ATTACHMENT OF AN EAS MARKER TO AN ARTICLE AFTER TAGGING

[75] Inventors: Mark J. Rankin, Media, Pa.; Anthony F. Piccoli, Audubon, N.J.

[73] Assignee: Checkpoint Systems, Inc., Thorofare, N.J.

[21] Appl. No.: 09/090,659

[22] Filed: Jun. 4, 1998

[51] Int. Cl.[7] ..... G08B 13/187

[52] U.S. Cl. ..... 340/572.1; 340/522; 340/540; 340/551; 340/572.4; 340/572.5; 340/825.34; 340/825.54; 340/825.55

[58] Field of Search ..... 340/572.1, 572.4, 340/572.5, 551, 540, 522, 825.34, 825.54, 825.55

[56] References Cited

U.S. PATENT DOCUMENTS

| | | | |
|---|---|---|---|
| 3,752,960 | 8/1973 | Walton | 340/825.3 |
| 3,816,708 | 6/1974 | Walton | 340/825.3 |
| 4,223,830 | 9/1980 | Walton | 235/380 |
| 4,580,041 | 4/1986 | Walton | 235/380 |
| 4,647,917 | 3/1987 | Anderson, III et al. | 340/572.4 |
| 4,675,655 | 6/1987 | Anderson et al. | 340/505 |
| 5,081,455 | 1/1992 | Gill et al. | 340/572.1 |
| 5,182,544 | 1/1993 | Aquilera et al. | 340/572.5 |
| 5,276,431 | 1/1994 | Piccoli | 340/572.5 |
| 5,347,263 | 9/1994 | Carroll et al. | 340/572.4 |
| 5,430,441 | 7/1995 | Bickley et al. | 340/825.54 |
| 5,446,447 | 8/1995 | Carney et al. | 340/572.4 |
| 5,455,563 | 10/1995 | Davies | 340/551 |
| 5,463,376 | 10/1995 | Stoffer | 540/572.4 |
| 5,495,230 | 2/1996 | Lian | 340/572.1 |

*Primary Examiner*—Glen Swann

*Attorney, Agent, or Firm*—Akin, Gump, Strauss, Hauer & Feld, L.L.P.

[57] ABSTRACT

An electronic system verifies that an article has been tagged with an electronic article surveillance marker. The marker includes a resonant circuit for use in detecting the presence of the article by receiving an interrogation signal and returning a response signal. In the system, the physical presence of an article is detected using an article presence detector which outputs an article presence signal upon physical detection thereof. An interrogation zone is monitored with an interrogator for disturbances in the form of a response signal caused by the presence of a marker within the interrogation zone. The interrogator outputs an interrogator output signal when a marker is detected in the interrogation zone. The article presence signals and the interrogator output signals are received in a processor. After an article presence signal is received from a newly physically detected article, the processor determines whether an interrogator output signal is received as a result of an interrogation of the newly physically detected article. The processor outputs either a first or second output signal depending upon whether after an article presence signal is received from a newly physically detected article, the processor receives an interrogator output signal as a result of an interrogation of the newly physically detected article.

20 Claims, 3 Drawing Sheets

SYSTEM FOR VERIFYING ATTACHMENT OF AN EAS MARKER TO AN ARTICLE AFTER TAGGING

BACKGROUND OF THE INVENTION

Electronic article surveillance (EAS) systems for detecting and preventing theft or unauthorized removal of articles or goods from retail establishments and/or other facilities, such as libraries, have become widespread. In general, such security systems use a security tag which is secured to or associated with an article (or its packaging), typically an article which is readily accessible to potential customers or facility users and, therefore, is susceptible to unauthorized removal. In general, such EAS systems are employed for detecting the presence (or the absence) of a security tag and, thus, a protected article within a surveilled security area or detection zone, also referred to herein as an "interrogation zone". In most cases, the detection zone is located at or around an exit or entrance to the facility or a portion of the facility.

One type of EAS system which has gained widespread popularity uses a security tag which includes a self-contained, passive resonant circuit in the form of a small, generally planar printed circuit which resonates at a predetermined detection frequency within a detection frequency range. A transmitter, which is also tuned to the detection frequency, transmits electromagnetic energy or an interrogation signal into the detection zone. A receiver, tuned to the detection frequency, is positioned proximate to the detection zone. Typically, the transmitter and a transmitter antenna are located on one side of an exit or aisle and the receiver and a receiver antenna are located on the other side of the exit or aisle, so that a person must pass between the transmitter and receiver antennas to exit the facility. When an article having an attached security tag moves into or passes through the detection zone, the security tag is exposed to the transmitted energy (the security tag is interrogated), resulting in the resonant circuit of the tag resonating to provide an output signal detectable by the receiver. The detection of such an output signal by the receiver indicates the presence of an article with a security tag within the detection zone and the receiver activates an alarm to alert appropriate security or other personnel.

One well-known EAS system has a transmitting and detecting frequency in the radio frequency range. The security tags used with such systems are referred to as RF tags or RF security tags. The RF tags associated with each article may be identical so that all articles, regardless of size or value, which include the security tag return an identical signal to the receiver. Alternatively, the RF tags may be passive resonant security tags which return unique or semi-unique identification codes. U.S. Pat. No. 5,446,447 (Carney et al.), U.S. Pat. No. 5,430,441 (Bickley et al.), and U.S. Pat. No. 5,347,263 (Carroll et al.) disclose three examples of such security tags. These security tags typically include an integrated circuit to generate the identification code. Such "intelligent" security tags provide additional information about the article detected in the zone of the interrogator. These intelligent security tags typically respond to, and transmit signals, in the radio frequency range, and are known in the art as "radio frequency identification (RFID) tags or "intelligent security tags." RFID tags are used in RFID systems. Intelligent security tags may also resonate at non-RF frequency bands, and may be referred generically as "EAS markers."

Existing EAS systems of the type described above and of other types have been shown to be effective in preventing the theft or unauthorized removal of articles.

As noted above, security tags are secured to or associated with an article (or its packaging). This process, referred to herein as "tagging" the article is typically performed in a retail store by store employees. To reduce personnel costs and errors caused by store employees, some retail establishments are insisting that articles be tagged before they arrive at the store or a store distribution center. Furthermore, some manufacturers are pretagging articles with intelligent RFID tags before shipment to allow for lifecycle tracking of the article. One method for achieving the desired pretagging is to tag the articles during or after the assembly process, or as they are prepared for packaging or shipment from the manufacturer or manufacturer's distribution center.

One issue associated with such pretagging is that there needs to be some assurance that the security tag was properly applied to the article or packaging and that the security tag is in a functional state, since the receiving stores or other facilities may no longer verify the existence of active security tags on presumably pretagged articles. Thus, if the store's EAS system does not detect any security tags as a customer exits the store, it is presumed that the security tags on any purchased items were properly deactivated or removed. The conventional EAS system cannot detect a failure by the manufacturer to tag the articles with a properly functioning tag.

The present invention fulfills this need by providing a system which verifies proper tagging and proper functioning of the tag at the tag application source.

BRIEF SUMMARY OF THE INVENTION

The present invention provides a method for verifying that an article has been tagged with an electronic article surveillance marker. The marker includes a resonant circuit for use in detecting the presence of the article by receiving an interrogation signal and returning a response signal. The method comprises detecting the physical presence of an article using an article presence detector. The article presence detector outputs an article presence signal upon physical detection thereof. An interrogation zone is monitored with an interrogator for disturbances in the form of a response signal caused by the presence of a marker within the interrogation zone. The interrogator outputs an interrogator output signal when a marker is detected in the interrogation zone. The article presence signals and the interrogator output signals are received in a processor. After an article presence signal is received from a newly physically detected article, the processor determines whether an interrogator output signal is received as a result of an interrogation of the newly physically detected article. The processor outputs a first output signal if after an article presence signal is received from a newly physically detected article, the processor receives an interrogator output signal as a result of an interrogation of the newly physically detected article. The processor outputs a second output signal if after an article presence signal is received from a newly physically detected article, the processor does not receive an interrogator output signal as a result of an interrogation of the newly physically detected article.

Another embodiment of the present invention discloses a system having the same functions described above for verifying that an article has been tagged with a marker.

In other embodiments of the present invention, article detection occurs after interrogation and the final verification steps are reversed.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
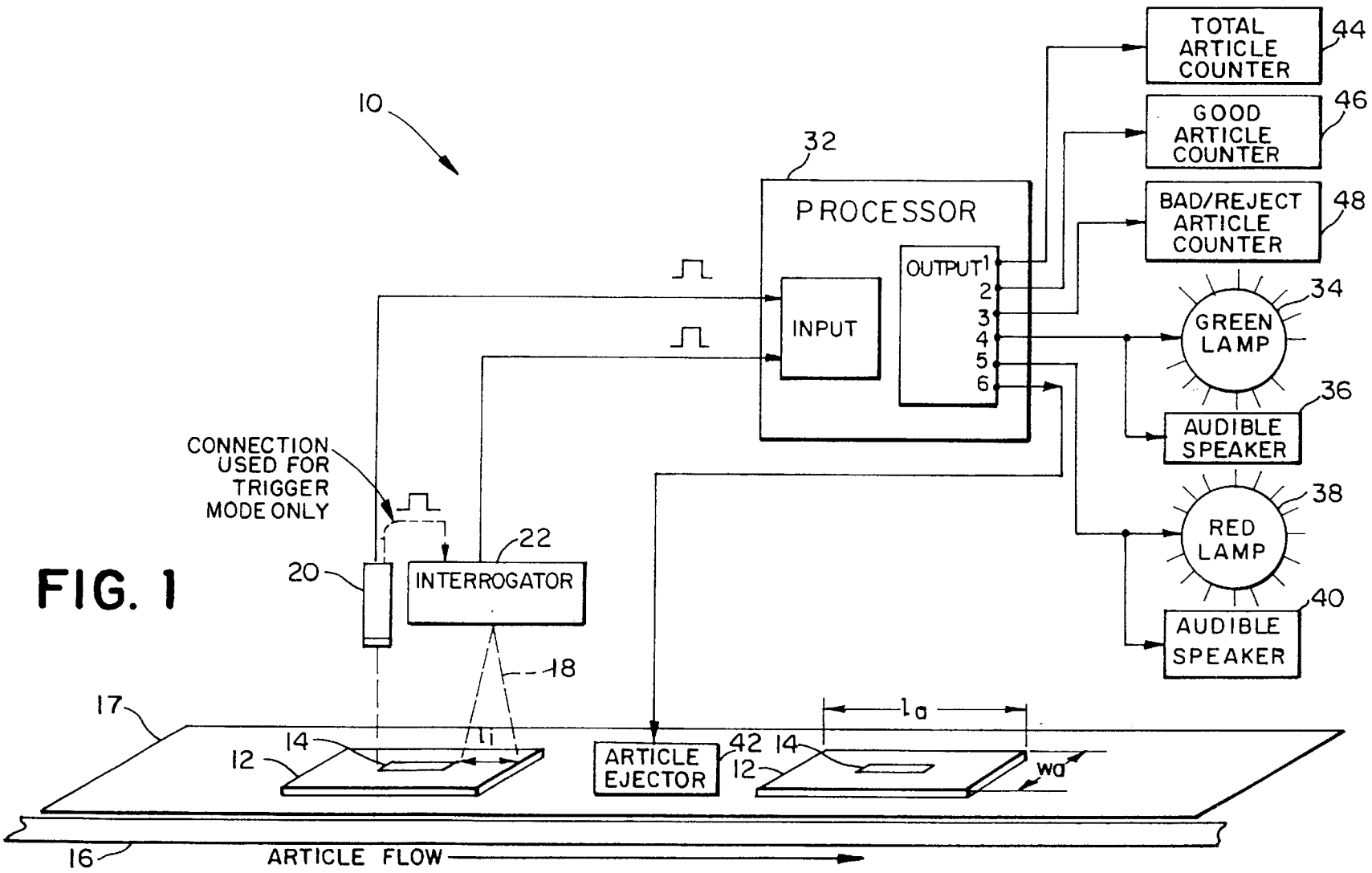
FIG. 1 is a block diagram schematic of a system for verifying attachment of a security tag to an article, in accordance with a preferred embodiment of the invention.

Certain terminology is used herein for convenience only and is not be taken as a limitation on the present invention. In the drawings, the same reference numerals are employed for designating the same elements throughout the several figures.

FIG. 1 shows a system 10 in accordance with a preferred embodiment of the present invention. Generally, the system 10 is used for verifying that a product or article or its packaging, either of which are hereafter referred to as "article 12", has been tagged with a resonant circuit-type security tag 14, also referred to herein as an "EAS marker." The system 10 may be part of an assembly line 16 having a conveyer 17 for moving a succession of articles 12 during article production or packaging. The system 10 is located downstream from a tagging station or tag applying operation (not shown). One suitable location for the system 10 would be at or near the end of the article handling process. Placing the system 10 at such a location would increase the likelihood of detecting tagging problems just before the article is shipped to the retailer. The verification process occurs in an interrogation zone 18 which may be a predetermined region of the assembly line 16, defined by phantom lines in FIG. 1.

The system 10 includes an article presence detector 20 for detecting via electronic or optical means the physical presence of an article 12 (hereafter, "physical detection") and outputting an article presence signal upon physical detection thereof. In the present embodiment of the invention, the article presence signal is a pulse signal having a "1" or high logic level. Thus, during the entire time in which the article 12 passes within the detection range of the detector 20, the pulse signal has a"1" or high logic level. When no article 12 is being detected, the pulse signal has a"0" or low logic level. The article presence detector 20 should be positioned with respect to the assembly line 16 so that the pulse signal is at a constant"1" or high logic level from the time in which the leading edge of the article 12 passes within the detection range of the detector 20 to the time in which the trailing edge of the article 12 passes out of the detection range of the detector 20. If the article presence detector 20 is not properly positioned, there may a period of discontinuity in the pulse signal which would cause the system 10 to presume that two different articles passed by the detector 20. If it is not possible to appropriately position the article presence detector 20, additional circuitry should be used to correct for discontinuous pulse signals so that any breaks in the pulse signal at a predetermined window of time after an initial pulse would be ignored. The length ($1_a$) of the article 12 and the conveyer speed of the assembly line 16 could be used to determine the applicable time window.

The article presence detector 20 may be a photodetection device which emits light from a source and detects the presence or absence of light at a detector. Photodetection devices are well-known in the prior art and thus are not described in further detail herein. Other types of article presence detectors are within the scope of the invention, including infrared sensors, ultrasonic sensors, acoustic sensors, mechanical sensors, and the like.

The system 10 also includes a reader or interrogator 22 suitable for use with the security tag 14. The interrogator 22 and the security tag 14 communicate by inductive coupling, as is well-known in the art. The interrogator 22 monitors the interrogation zone 18 for disturbances in the form of a response signal caused by the presence of a security tag within the interrogation zone 18.

Figure 2:
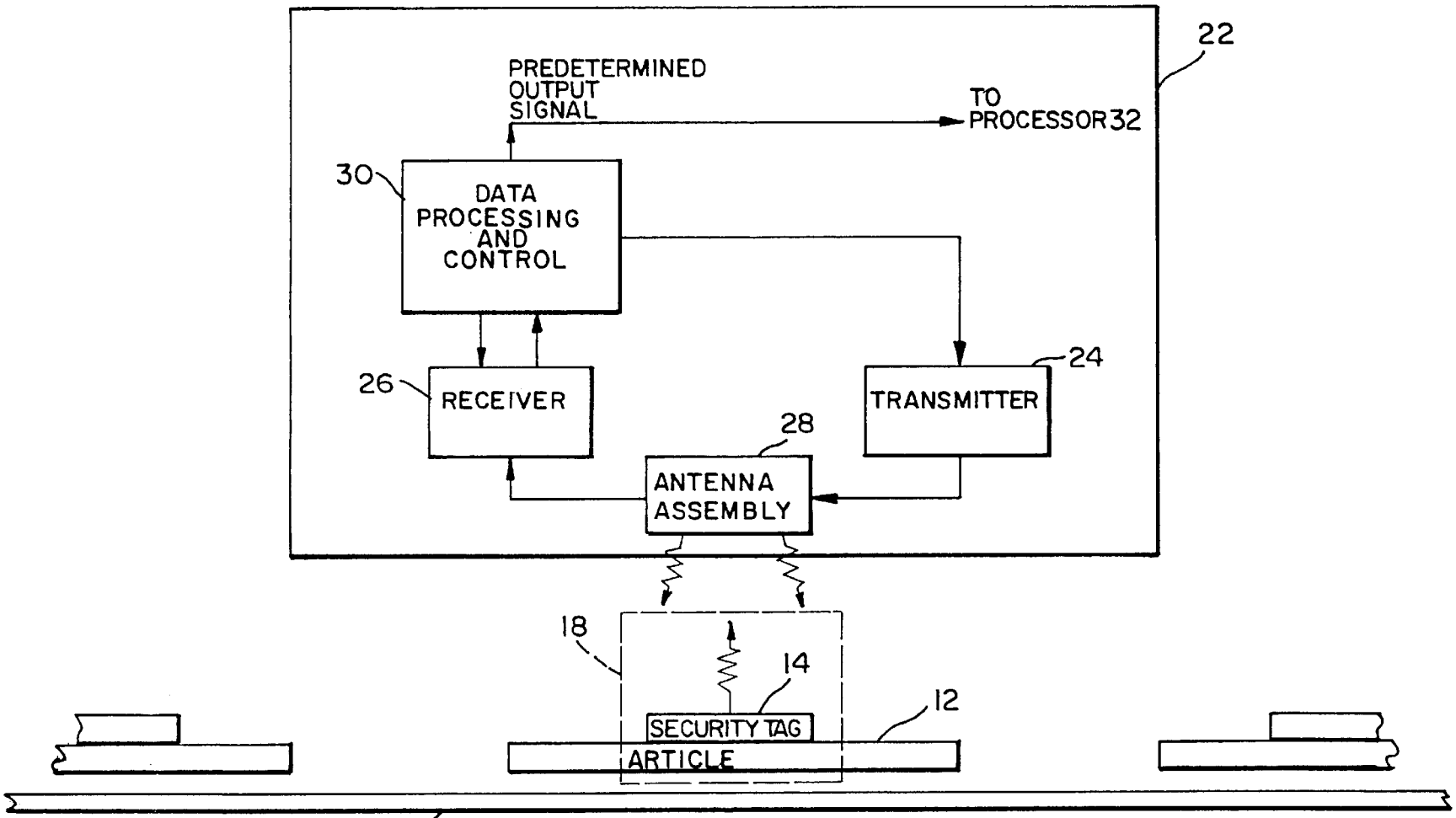
FIG. 2 is a detailed functional block diagram schematic of an interrogator for the system in FIG. 1 which reads RF tags.

FIG. 2 is a block diagram schematic of an interrogator 22 suitable for use with the present invention. Referring to FIG. 2, the interrogator 22 includes a transmitter 24, receiver 26, antenna assembly 28, and data processing and control circuitry 30, each having inputs and outputs. The output of the transmitter 24 is connected to a first input of the receiver 26, and to the input of the antenna assembly 28. The output of the antenna assembly 28 is connected to a second input of the receiver 26. A first and a second output of the data processing and control circuitry 30 are connected to the input of the transmitter 24 and to a third input of the receiver 26, respectively. Furthermore, the output of the receiver 26 is connected to the input of the data processing and control circuitry 30. The interrogator 22 outputs a predetermined interrogator output signal when a security tag 14 is detected in the interrogation zone 18. Interrogators having this general configuration may be built using circuitry described in U.S. Pat. Nos. 3,752,960, 3,816,708, 4,223,830 and 4,580,041, all issued to Walton, all of which are incorporated by reference in their entirety herein. The physical implementation of the interrogator 22 is dictated by size, shape and power constraints associated with its location in the system 10.

Referring again to FIG. 1, the interrogation zone 18 should have a sufficient length ($1_i$) to ensure that at least one interrogation of the article 12 can occur after physical detection thereof as the conveyer 17 passes the article 12 along the assembly line 16. However, the length ($1_i$) of the interrogation zone 18 should not be so great that it potentially covers two adjacent articles 12, such as a currently read and a previously read article 12. The exact length of the interrogation zone 18 will thus depend upon the length ($1_a$) of the article 12, the distance between adjacent articles 12 on the conveyer 17 and the speed of the conveyer 17.

In the present embodiment of the invention, the predetermined interrogator output signal is a pulse signal having a "1" or high logic level. Thus, if a security tag 14 is detected after an interrogation, the interrogator output signal has a "1" or high logic level. If no security tag 14 is detected after an interrogation, the interrogator output signal has a "0" or low logic level.

The interrogator 22 may operate in either a continuous or a triggered mode. In the continuous mode, the interrogator 22 continuously emits interrogation signals and continuously detects response signals. In the triggered mode, the interrogator 22 is connected to the output of the article presence detector 20 and emits interrogation signals only upon receiving an article presence signal from the detector 20. This connection is shown by a dashed line in FIG. 1. With respect to FIG. 2, one end of the dashed line would connect to the data processing and control circuitry 30. The connection between the interrogator 22 and the article presence detector 20 may also be through a commonly shared processor, described below.

Consideration must be given to the placement of the interrogator 22 with respect to the article presence detector 20 so that article detection and interrogation functions are properly coordinated. One preferred scheme is to place the interrogator 22 (and thus the interrogation zone 18) downstream from, but substantially adjacent to, the article presence detector 20. In this manner, the article 12 being interrogated will be the same article 12 that was recently (newly) physically detected. Of course, sufficient space must be left between adjacent articles 12 to ensure that a previously detected and interrogated article 12 is not reinterrogated. If it is not physically possible to place the interrogator 22 directly next to the article presence detector, additional processing must be performed on the detector 20 and interrogator 22 output signals to coordinate their timing, as discussed in further detail below.

The system 10 also has a processor 32 having an input connected to the article presence detector 20 and the interrogator 22 for receiving respective output signals therefrom. The processor 32 performs at least the following functions:

(1) After an article presence signal is received from a newly physically detected article, the processor 32 detects whether an interrogator predetermined output signal is received as a result of an interrogation of the newly physically detected article.

If the interrogator 22 is directly next to, and downstream from, the article presence detector 20, this function may be performed by detecting whether an interrogator predetermined output signal is received during a time period in which an article presence signal is being received. The interrogation is thus performed while the article presence signal is present and before the next article presence signal is received. The detection is performed by logically ANDing the interrogator predetermined output signal and the article presence signal, and determining if a "1" or high logic level results from the AND operation at any time when the article presence signal is being received.

If the interrogator 22 is significantly downstream from the article presence detector 20, this function may be performed by first detecting the physical presence of an article, and second, a predetermined time later based on the distance between the interrogator 22 and the detector 20 and the speed of the conveyer 17, detecting whether the interrogator predetermined output signal is received from the interrogator 22. In this case, the interrogation could potentially be performed after the next article presence signal is received. The results are then logically ANDed together in the same manner as above.

(2) Outputs a first output signal if after an article presence signal is received from a newly physically detected article 12, the processor 32 detects an interrogator predetermined output signal received as a result of an interrogation of the newly physically detected article 12. When this condition occurs, it is presumed that the article 12 was properly tagged. This output signal is routed to output 4 of the processor 32 which is connected to a green indicator or lamp 34 and/or to an audible speaker 36 which may output a beep.

(3) Outputs a second output signal if after an article presence signal is received from a newly physically detected article 12, no predetermined output signal is received by the processor 32 as a result of an interrogation of the newly physically detected article 12. When this condition occurs, it is presumed that the article 12 was not tagged, was not properly tagged or was tagged with a malfunctioning or inactive security tag 14. This condition requires immediate follow-up. This output signal may be routed to optional outputs 5 and 6 of the processor 32. Output 5 is connected to a red warning indicator or lamp 38 and/or to an audible speaker/alarm 40 which outputs a different sound or frequency than the audible alarm 36. Alternatively, output 5 is not used, and the absence of a signal from output 4 is presumed to indicate that the article 12 has a tagging problem.

Output 6 is connected to an article ejector 42 which removes the currently physically detected article 12 from the assembly line 16 for follow-up investigation. (4) Counts the total number of articles detected by the article presence detector 12. This count signal is sent to output 1 of the processor 32 which is connected to a total article counter 44.

(5) Counts the total number of articles detected by the article presence detector 12 which resulted in a first output signal being output by the processor 32. This count signal is sent to output 2 of the processor 32 which is connected to a"good" counter 46. (6) Counts the total number of articles detected by the article presence detector 12 which resulted in a second output signal being output by the processor 32. This count signal is sent to output 2 of the processor 32 which is connected to a "bad" or "reject" counter 48.

The processor 32 may be a programmable logic circuit, a microprocessor, or any other suitable type of computer device.

Figure 3:
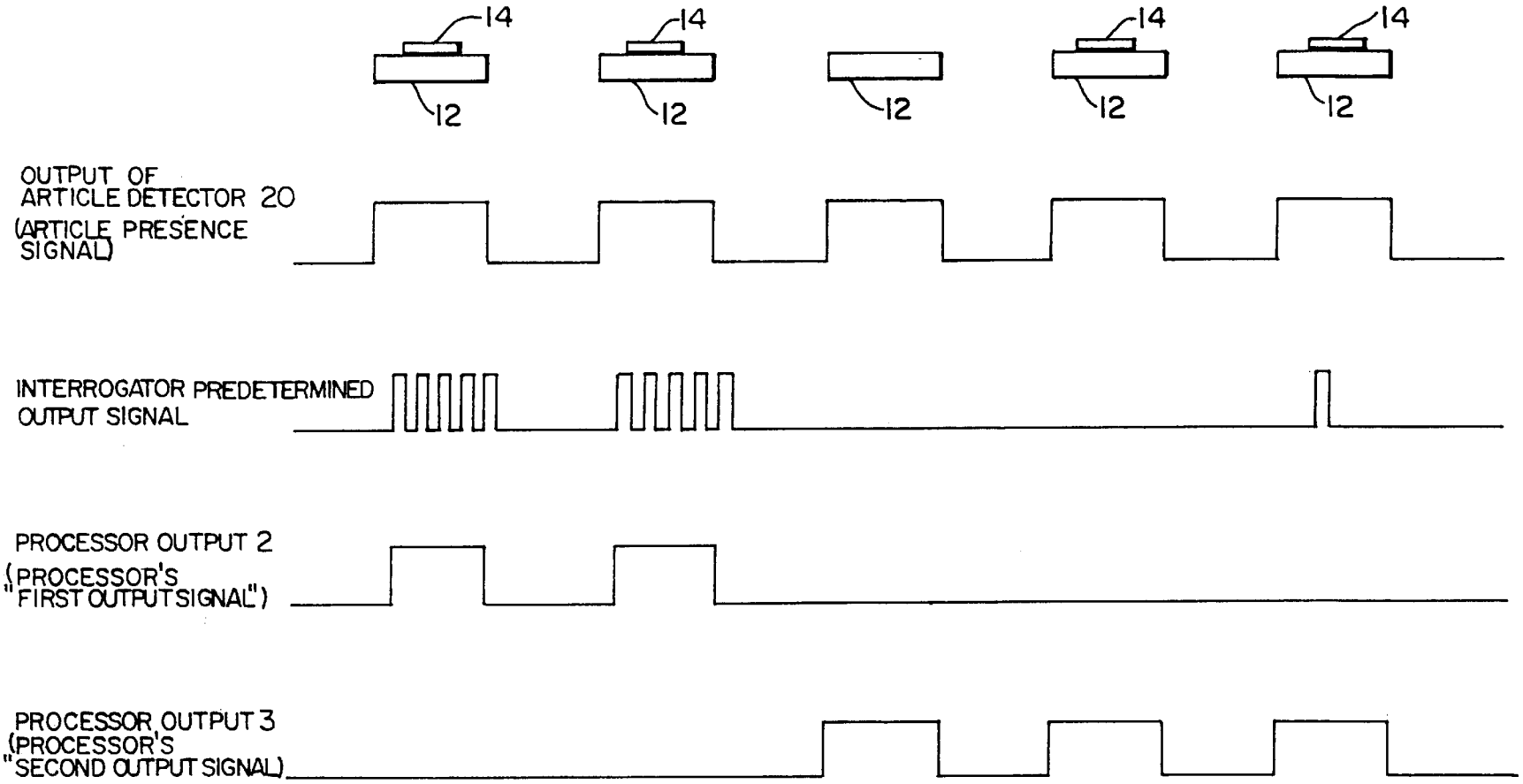
FIG. 3 is a logic diagram of signals used for verifying attachment of the RF tags in accordance with one embodiment of the present invention.

FIG. 3 shows a timing diagram for a succession of five articles 12 which pass through the interrogation zone 18. In FIG. 3, the interrogator 22 (and thus the interrogation zone 18) is downstream from, and substantially adjacent to, the article presence detector 20 so that the processor 32 looks for a valid security tag response signal during the time in which the article presence detector 20 is detecting the physical presence of an article 12. Also, the interrogator 22 used in the FIG. 3 scheme operates in a continuous mode. For ease of illustration, FIG. 3 shows only five pulses output from the interrogator 22 during the time period in which each article 12 is in the detection zone 18. The actual number of pulses will depend upon the pulse frequency of the interrogator 22 and the speed of the assembly line 16. In an alternative embodiment of the invention, only one interrogation signal is emitted for each article interrogation. In this embodiment, only one (or no) pulse output would be generated.

Referring to FIG. 3, the first and second articles 12 are properly tagged since there is at least one pulse output from the interrogator 22 during each respective article presence signal. Thus, a "good" count signal is generated at processor output 2. The third article 12 is missing a security tag 14. Thus, a "bad" count signal is generated at processor output 3. The fourth article 12 has a defective, non-responsive security tag 14 which also causes a "bad" count signal to be generated.

With respect to the first and second articles 12, the interrogator predetermined output signal is shifted slightly forward in time from the output of the article presence signal because the interrogator 22 is slightly downstream from the article presence detector.

Still referring to FIG. 3, the fifth article 12 has a partially defective, partially responsive security tag 14 because it only emits one pulse, instead of five pulses, during the interrogation period. The processor 32 should preferably be programmed to reject such articles 14, since it is likely that there is some defect in the security tag 14 or in its placement on the article 12, which resulted in a poor response. If the tag 14 responded poorly to the interrogator 22, there is a chance that it may also respond poorly to the EAS system in the retail store, thereby causing a failure to read.

For ease of illustration, the security tags 14 are shown as being relatively large and visible in relation to the article 12. In actual use, the security tags 14 may be very small or even microscopic in comparison to the size of the article 12. The security tags 14 may also be hidden from view on or in the article, or may be incorporated into the article packaging.

If the security tag 14 is an RFID tag, the processor 32 may optionally use the collected ID data to perform additional functions other than to establish article presence and proper tagging. For example, the processor 32 may check the ID data to ensure that the tags were placed on the correct articles (i.e., the articles which are currently flowing on the assembly line).

If desired, the interrogator 22 may be located upstream, instead of downstream, from the article presence detector 20. This scheme requires a reversal of the output signal processing steps and the timing therebetween. The exact implementation of this scheme would be understood by an artisan from the description above and thus is not described in detail herein.

The present invention improves the integrity of collections of pretagged articles, thereby enhancing the functionality of existing EAS systems which are used with such pretagged articles.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A system for verifying that an article has been tagged with an electronic article surveillance marker, the marker including a resonant circuit for use in detecting the presence of the article by receiving an interrogation signal and returning a response signal, the system comprising:

(a) an article presence detector for detecting the physical presence of an article and outputting an article presence signal upon physical detection thereof;

(b) an interrogation zone;

(c) an interrogator for monitoring the interrogation zone for disturbances in the form of a response signal caused by the presence of a marker within the interrogation zone which is associated with a physically detected tagged article within the interrogation zone, the interrogator outputting a predetermined output signal when such a marker is detected in the interrogation zone; and (d) a processor connected to the article presence detector and the interrogator for receiving respective output signals therefrom, whereby after an article presence signal is received from a newly physically detected article, the processor determines whether an interrogator output signal is received as a result of an interrogation of the newly physically detected article.

2. A system according to claim 1 wherein the processor outputs a good output signal if after an article presence signal is received from a newly physically detected article, the processor receives an interrogator output signal as a result of an interrogation of the newly physically detected article.

3. A system according to claim 2 further comprising:

(e) an indicator connected to the processor, the indicator being activated if the processor outputs a good output signal.

4. A system according to claim 2 further comprising:

(e) a second counter connected to the processor, the second counter counting the total number of articles detected by the article presence detector which resulted in a good output signal being output by the processor.

5. A system according to claim 1 wherein the processor outputs a bad output signal if after an article presence signal is received from a newly physically detected article, the processor does not receive an interrogator output signal as a result of an interrogation of the newly physically detected article.

6. A system according to claim 5 further comprising:

(e) an alarm connected to the processor, the alarm being activated if the processor outputs a bad output signal.

7. A system according to claim 5 further comprising:

(e) an indicator connected to the processor, the indicator being activated if the processor outputs a bad output signal.

8. A system according to claim 5 further comprising:

(e) a third counter connected to the processor, the third counter counting the total number of articles detected by the article presence detector which resulted in a bad output signal being output by the processor.

9. A system according to claim 5 further comprising:

(e) an assembly line having a conveyer for moving a succession of articles in a first direction; and (f) an article ejector connected to the processor for ejecting the currently physically detected article from the conveyer if the processor outputs a bad output signal.

10. A system according to claim 1 wherein the processor detects whether the interrogator output signal is received during a time period in which an article presence signal of a newly detected article is being received.

11. A system according to claim 1 wherein the processor is a programmable logic circuit.

12. A system according to claim 1 further comprising:

(e) an assembly line having a conveyer for moving a succession of articles in a first direction, wherein the article presence detector and the interrogation zone are located along a predetermined region of the assembly line.

13. A system according to claim 1 wherein the article presence detector is a photodetection device.

14. A system according to claim 1 further comprising:

(e) a total counter connected to the processor, the total counter counting the total number of articles detected by the article presence detector.

15. A system according to claim 1 where the interrogator output signal is a signal of a predetermined quality.

16. A method for verifying that an article has been tagged with an electronic article surveillance marker, the marker including a resonant circuit for use in detecting the presence of the article by receiving an interrogation signal and returning a response signal, the method comprising:

(a) detecting the physical presence of an article using an article presence detector, the article presence detector outputting an article presence signal upon physical detection thereof;

(b) monitoring an interrogation zone with an interrogator for disturbances in the form of a response signal caused by the presence of a marker within the interrogation zone, the interrogator outputting an interrogator output signal when a marker is detected in the interrogation zone; and (c) receiving the article presence signals and the interrogator output signals in a processor, whereby after an article presence signal is received from a newly physically detected article, the processor determines whether an interrogator output signal is received as a result of an interrogation of the newly physically detected article.

17. A method according to claim 16 further comprising:

(d) outputting a good output signal by the processor if after an article presence signal is received from a newly physically detected article, the processor receives an interrogator output signal as a result of an interrogation of the newly physically detected article.

18. A method according to claim 16 further comprising:

(d) outputting a bad output signal by the processor if after an article presence signal is received from a newly physically detected article, the processor does not receive an interrogator output signal as a result of an interrogation of the newly physically detected article.

19. A method according to claim 18 wherein a succession of articles move along an assembly line in a first direction by a conveyer, the assembly line including an article ejector connected to the processor, the method further comprising:

(e) ejecting the newly physically detected article from the conveyer if the processor outputs a bad output signal.

20. A method according to claim 16 wherein the interrogator output signal is a signal of a predetermined quality.

* * * * *